US010907399B2

(12) United States Patent
Penland

(10) Patent No.: US 10,907,399 B2
(45) **Date of Patent: *Feb. 2, 2021**

(54) LOCKABLE FIREARM CABINET

(71) Applicant: Rustin B. Penland, Nederland, TX (US)

(72) Inventor: Rustin B. Penland, Nederland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/166,024

(22) Filed: Oct. 19, 2018

(65) Prior Publication Data

US 2019/0055772 A1 Feb. 21, 2019

Related U.S. Application Data

(63) Continuation-in-part of application No. PCT/US2017/026067, filed on Apr. 5, 2017, and a continuation-in-part of application No. 15/134,985, filed on Apr. 21, 2016, now Pat. No. 10,287,816.

(51) Int. Cl.

| | |
|---|---|
| ***E05G 1/04*** | (2006.01) |
| ***E05G 1/10*** | (2006.01) |
| ***F41C 33/06*** | (2006.01) |
| ***A47B 81/00*** | (2006.01) |

(52) U.S. Cl.

CPC ..... *E05G 1/04* (2013.01); *E05G 1/10* (2013.01); *F41C 33/06* (2013.01); *A47B 81/005* (2013.01); *E05G 2700/02* (2013.01)

(58) Field of Classification Search

CPC ..... E05G 1/04; E05G 1/10; E05G 2700/02; A47B 81/005; F41A 17/063; F41C 33/06

USPC ..... 70/85–88, 123, 58, 63; 42/70.01, 70.06, 42/70.11; 109/47, 67, 68; 211/64; 206/317; 224/912, 913; 312/222, 290, 312/242, 245, 311

See application file for complete search history.

(56) References Cited

U.S. PATENT DOCUMENTS

| | | | |
|---|---|---|---|
| 345,337 | A | 7/1886 | Tollner |
| 1,252,776 | A | 1/1918 | Camper |
| 1,334,852 | A | 3/1920 | Gorowitz |

(Continued)

FOREIGN PATENT DOCUMENTS

| | | | |
|---|---|---|---|
| CN | 201924745 | U | 8/2011 |
| WO | 2005/013031 | A2 | 2/2005 |
| WO | 2005/059467 | A1 | 6/2005 |

OTHER PUBLICATIONS

U.S. Appl. No. 15/134,985, Restriction Requirement, dated Jul. 5, 2018.

(Continued)

*Primary Examiner* — Lloyd A Gall

(74) *Attorney, Agent, or Firm* — Winston & Strawn LLP

(57) ABSTRACT

Devices for securing and retaining firearms that include either a lockable firearm cabinet or a firearm securement system. The cabinet includes a receptacle; a locking device and locking mechanism; a spring for biasing the locking mechanism in the locked position; and a bar for overriding the locking mechanism. The securement system includes a wall mounted plate for securing a firearm thereto; a release mechanism that allows the firearm to be removed and electronics for wirelessly communicating with a computer and the firearm to provide information regarding removal of the firearm or firearm cartridge from the wall mounted plate.

13 Claims, 16 Drawing Sheets

(56) References Cited

U.S. PATENT DOCUMENTS

| | | | |
|---|---|---|---|
| 1,410,581 | A | 3/1922 | Langer |
| 1,510,561 | A | 10/1924 | Segal |
| 1,512,141 | A | 10/1924 | Segal |
| 1,563,914 | A | 12/1925 | Muzzio |
| 2,512,140 | A | 6/1950 | Childs |
| 4,768,021 | A | 8/1988 | Ferraro |
| 4,836,707 | A | 6/1989 | Myers |
| 5,168,994 | A | 12/1992 | Beletsky et al. |
| 5,416,472 | A | 5/1995 | Torii, Jr. |
| 5,416,826 | A | 5/1995 | Butler |
| 5,598,151 | A | 1/1997 | Torii, Jr. |
| 5,884,989 | A | 3/1999 | Truelove |
| 6,363,760 | B1 | 4/2002 | Sigmond |
| 6,382,002 | B1 | 5/2002 | Chen |
| 6,499,243 | B1 | 12/2002 | Herzog |
| 6,823,621 | B2 | 11/2004 | Gotfried |
| 6,957,771 | B2 | 10/2005 | Norris, Jr. |
| 6,965,541 | B2 | 11/2005 | Lapin et al. |
| 6,970,183 | B1 | 11/2005 | Monroe |
| 7,116,224 | B2 | 10/2006 | Mickler |
| 7,277,018 | B2 | 10/2007 | Reyes et al. |
| 7,336,169 | B2 | 2/2008 | Coonce et al. |
| 7,468,663 | B1 | 12/2008 | Rufolo, Jr. et al. |
| 7,656,286 | B2 | 2/2010 | Benson et al. |
| 7,714,720 | B2 | 5/2010 | Hietanen et al. |
| 7,986,231 | B1 | 7/2011 | Bentley et al. |
| 8,020,416 | B2 | 9/2011 | Talmage et al. |
| 8,186,188 | B1 | 5/2012 | Brown |
| 8,305,211 | B1 | 11/2012 | Morris et al. |
| 8,427,297 | B1 | 4/2013 | Markey et al. |
| 8,506,023 | B2 | 8/2013 | Goldie |
| 8,520,674 | B2 | 8/2013 | Samuels |
| 8,749,343 | B2 | 6/2014 | Cirker |
| 8,770,116 | B2 | 7/2014 | Heim et al. |
| 8,876,172 | B2 | 11/2014 | Denison et al. |
| 8,997,390 | B1 * | 4/2015 | Heizer ..... F41A 3/58 42/42.03 |
| 10,287,816 | B2 * | 5/2019 | Penland ..... E05G 1/04 |
| 2001/0033228 | A1 | 10/2001 | Kisreman et al. |
| 2002/0032976 | A1 | 3/2002 | Riener |
| 2002/0158095 | A1 | 10/2002 | Vor Keller et al. |
| 2005/0206279 | A1 | 9/2005 | Lilly |
| 2006/0283820 | A1 | 12/2006 | Peters et al. |
| 2008/0061991 | A1 | 3/2008 | Urban et al. |
| 2011/0175730 | A1 | 7/2011 | Stevenson |
| 2011/0247950 | A1 | 10/2011 | McGee |
| 2013/0298807 | A1 | 11/2013 | Wall et al. |
| 2013/0326585 | A1 | 12/2013 | Lo et al. |
| 2013/0326595 | A1 | 12/2013 | Myers et al. |
| 2014/0360073 | A1 | 12/2014 | Stewart et al. |
| 2017/0284755 | A1 | 10/2017 | Farringer |
| 2018/0073836 | A1 | 3/2018 | Romeo |

OTHER PUBLICATIONS

U.S. Appl. No. 15/134,985, Non-Final Rejection, dated Aug. 10, 2018.

Invitation to Pay Additional Fees and Communication Relating to Results of the Partial International Search, PCT/US2017/026067, dated Jul. 18, 2017.

International Search Report and Written Opinion, Appl. No. PCT/US2017/026067, dated Oct. 20, 2017.

International Preliminary Report on Patentability (Chapter I), Appl. No. PCT/US2017/026067, dated Nov. 1, 2018.

* cited by examiner

LOCKABLE FIREARM CABINET

CROSS-REFERENCE TO RELATED APPLICATIONS

This application is a continuation-in-part of U.S. application Ser. No. 15/134,985 filed Apr. 21, 2016, now U.S. Pat. No. 10,287,816, and International Application PCT/US2017/026067 filed Apr. 5, 2017, the entire content of each of which is expressly incorporated herein by reference thereto.

BACKGROUND

The invention relates to a lockable firearm cabinet which provides a secure repository for a firearm but which facilitates easy access to the firearm when necessary. The cabinet can be mounted in a wall, closet or furniture, or it can be used as a portable device for secure transport of a firearm.

There are numerous firearm cabinets that are intended to secure there in a firearm so that it cannot be removed and used except by and authorized person. These types of cabinets include various locking mechanisms and are arranged in a variety of configurations such as drawers, close to compartments, boxes, safes, and even mechanisms that immobilize the trigger mechanisms of the firearms.

Despite the current cabinets and related security devices, there still remains a need for an improved cabinet that can facilitate movement of the firearm in an inoperative condition as well as to prevent unauthorized access to the firearm during transport or subsequent storage. The present invention now provides a number of improvement firearm cabinets and security arrangements that are significantly advanced over what is known in the art.

SUMMARY OF THE INVENTION

The invention provides new and useful devices for securing and retaining firearms away from general access such that the firearms can only be retrieved and operated by an authorized user.

One embodiment of the invention relates to a firearm receptacle having an open interior and comprising a locking device associated with the interior of the receptacle for engaging an insertable structure that is attached to or forms part of a handle of a firearm, the locking device including a locking mechanism having a first position which engages the insertable structure to securely hold it in place within the receptacle and a second position wherein the locking mechanism is out of engagement with the insertable structure; biasing means for fixing the locking mechanism in the first position; and means for overriding the biasing means to move the locking mechanism to the second position wherein the insertable structure can be freely removed from or inserted into the locking mechanism.

The locking mechanism generally comprises male or female portions one of which is present in the receptacle and the other of which is associated with or forms part of the insertable structure. The locking mechanism preferably includes first and second arm members each having a protrusion or tab member that engages a mating aperture in the insertable structure when the locking mechanism is in the first position, and the biasing means comprises a spring which is operatively associated with the arm members to urge them toward each other and toward the first position.

The means for overriding the biasing means may comprise a rotatable cam member that is operatively associated with the arm members, the cam member having arm contact portions of different sizes, wherein, when the cam member is rotated, contact portions of larger dimensions contact the arm members to move them out of engagement with the insertable structure and into the second position. If desired, the rotatable cam member may be operatively associated with an external key lock so that a key inserted into the key lock can be used to rotate the cam member to move the arm members out of engagement with the insertable structure.

The means for overriding the biasing means may instead comprise flap members connected to the arm members through a pivot rod so that movement of the flap members also moves the arm members to overcome the biasing means and urge the arm and tab members to the second position.

The firearm receptacle preferably is rectangular in shape, and includes a door for access to the receptacle interior. If desired, an additional door that forms at least part of a wall member of the receptacle can be provided, wherein the receptacle includes a separate locking member to lock the receptacle in the housing. The door or doors can be opened by a biometric unlocking mechanism, a key pad, or a key.

Preferably, the firearm is a handgun having a handle the bottom of which is releasably mounted onto the insertable structure, wherein the insertable structure has a width that is no larger than that of the handgun handle. The receptacle can include a trigger engaging lock to prevent accidental discharge of the handgun when being transported.

The invention also relates to a lockable firearm cabinet comprising a housing having outer components surrounding an interior with the outer components including a base, one or more walls and a top; and one of the receptacles disclosed herein. The housing receives the receptacle as a drawer that can slide into the housing, such that the sliding of the receptacle completely into the housing causes the means for overriding the biasing means to disengage the locking mechanism from the insertable structure and further wherein the sliding removal of the receptacle from the housing locks the insertable member in the drawer. Also, after the receptacle is received in the housing of the cabinet, the insertable structure can be freely removed from or inserted into the locking mechanism.

The sliding of the receptacle completely into the housing causes the overriding means to disengage the locking mechanism from the insertable structure so that the firearm is ready to be removed when the receptacle interior is opened by an authorized user. Alternatively, the sliding removal of the receptacle from the housing locks the insertable member in the drawer. This locking can also be accomplished by turning the key to rotate the cam member.

In order to unlock the firearm when it is secured within the receptacle and housing, the overriding means preferably comprises a bar that engages secondary tab members associated with the arm members to move the secondary tab members and tab members to overcome the biasing means and urge the arm members to the second position. To gain access to the freely removable firearm, the door can be opened by a biometric unlocking mechanism, a key pad, or a key. Typical biometric unlocking mechanisms include a fingerprint detector, a retina scanner or face recognition for fastest access to the receptacle interior. Of course, conventional keys or keypads can instead be used if desired. The receptacle generally includes one or more activation buttons for sounding an alarm, activating a monitoring camera, or providing external communication when the firearm is removed from the receptacle. To use the firearm, the insertable structure may be removed from the firearm with a key.

In another embodiment, the invention relates to a firearm securement system, comprising a wall mounted plate that includes means for securing a firearm or firearm cartridge thereto; a release mechanism that allows the firearm to be removed from the wall plate, the release mechanism including a biometric unlocking mechanism, a key pad, or a key; and electronics for wirelessly communicating with a computer and with the firearm or firearm cartridge to provide information regarding removal of the firearm or firearm cartridge from the wall mounted plate.

This firearm securement system preferably further comprises one or more activation buttons for sounding an alarm, activating a monitoring camera, or providing external communication when the firearm or firearm cartridge is removed from the wall plate.

The electronics may be mounted on the wall plate and activated when the firearm or firearm cartridge is removed from the wall plate. Alternatively, the firearm or firearm cartridge may be mounted on an immobilization plate that is locked to the wall plate, with the electronics provided on one of the wall plate or the immobilization plate.

A preferred release mechanism comprises one or more claw members that grasp the firearm or firearm cartridge to lock it to the wall plate. Alternatively, the wall plate may include a snap locking mechanism that cooperates with structure on the firearm, firearm cartridge or immobilization plate.

Additionally, the firearm or firearm cartridge includes electronics that also communicate with the computer and that allow the firearm or firearm cartridge to be wirelessly disabled when necessary.

BRIEF DESCRIPTION OF THE DRAWINGS

Preferred features of the invention are more fully appreciated upon a review of the appended drawing figures, wherein.

DETAILED DESCRIPTION OF THE INVENTION

The invention also has a number of security systems that can be built into the cabinet of the invention or that can be used for separately accessing the internal compartment of a firearm storage cabinet. One use of the cabinet is as a weapon locker in a schoolroom with the teacher being the authorized user. Details of such a system can be found in U.S. copending patent application Ser. No. 14/104,944 filed Dec. 12, 2013, the entire content of which is expressly incorporated herein by reference thereto.

Figure 1A:
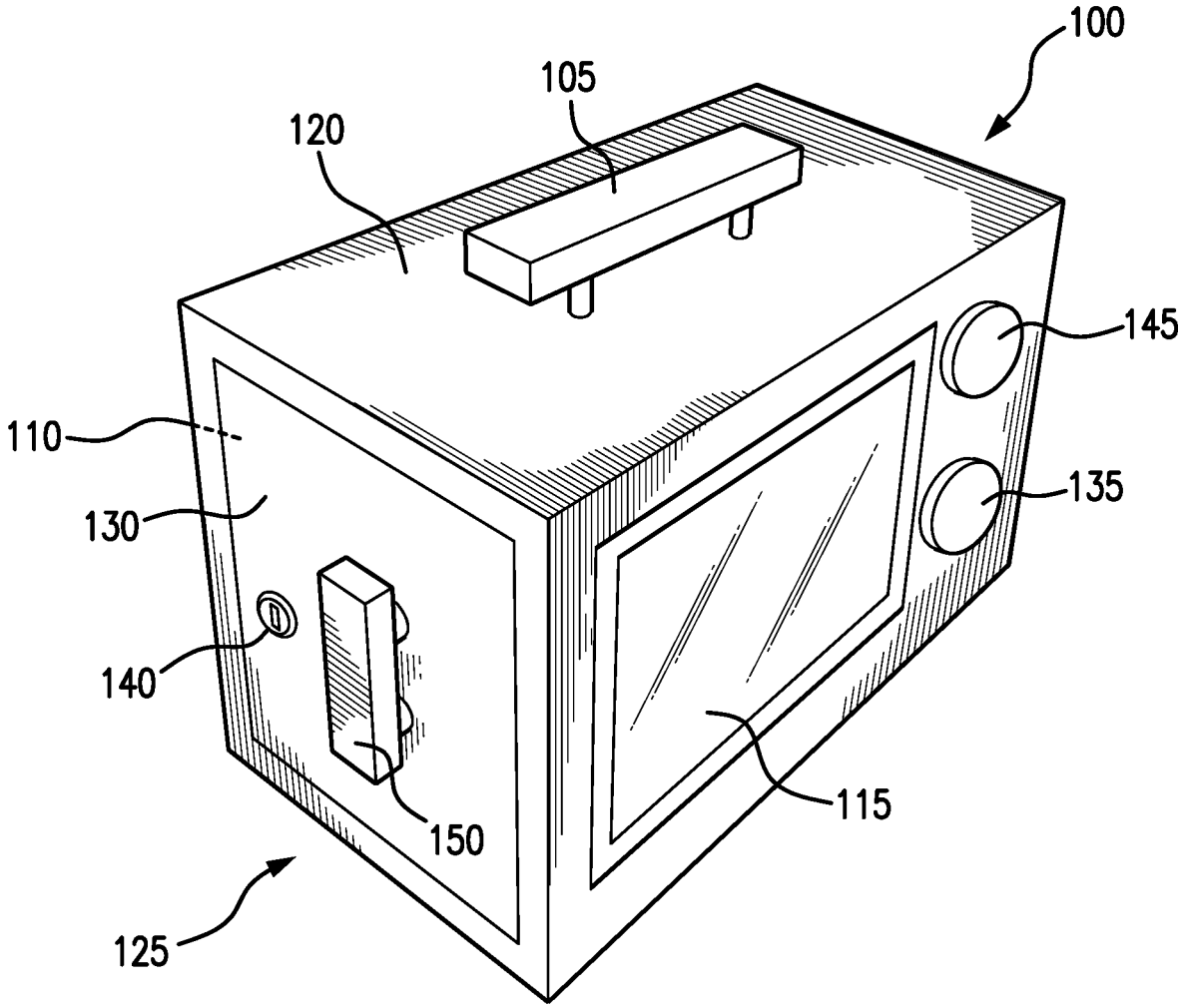
FIGS. 1A to 1C illustrate a firearm cabinet and receptacle according to the present invention.
Figure 1B:
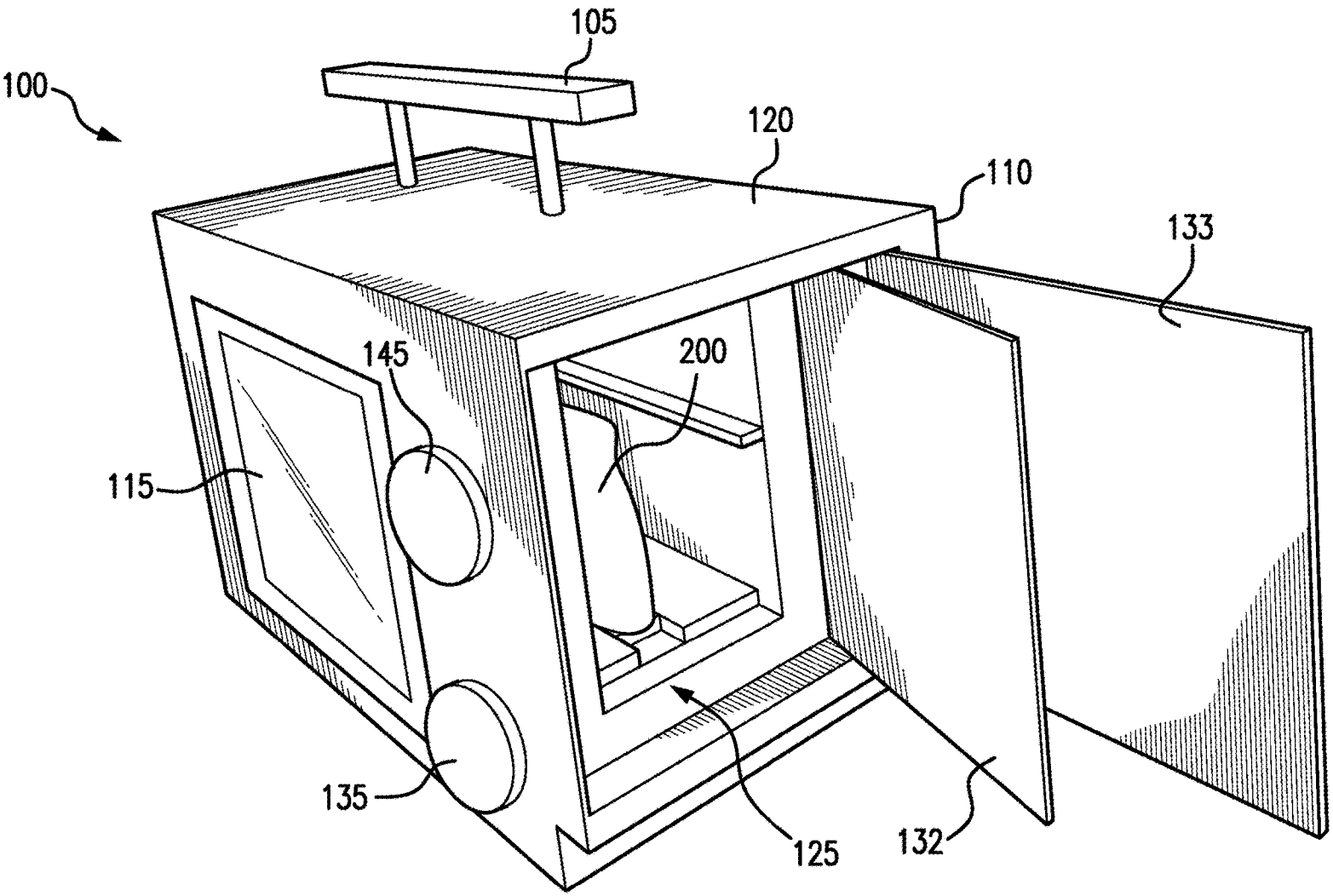
Figure 1C:
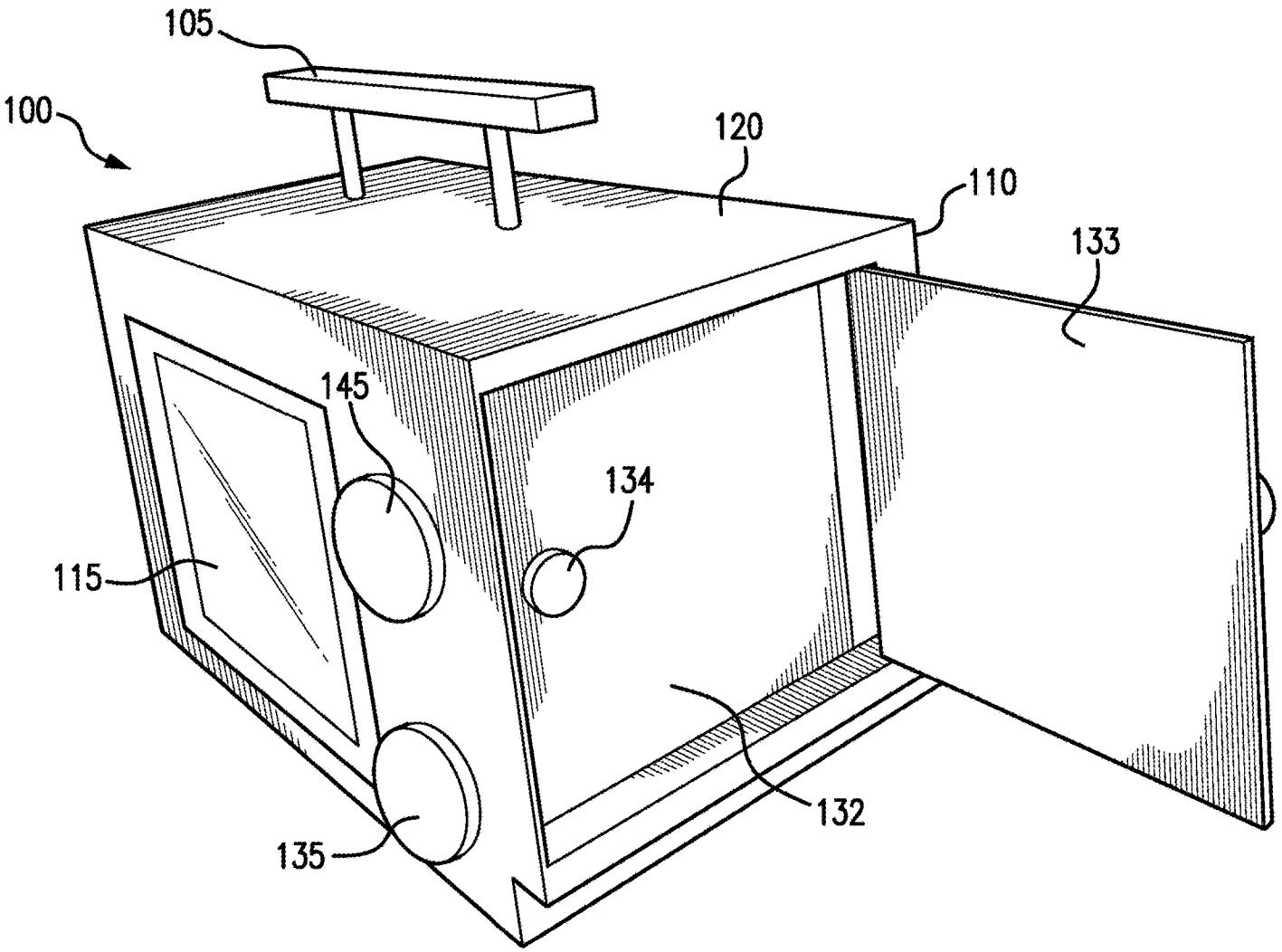

FIGS. 1A to 1C illustrate a lockable fire arm cabinet 100 according to the present invention. This cabinet 100 includes a housing having side 110, top 120, back and bottom walls which form an enclosure having a front opening. The front opening receives a receptacle 125, only the front plate 130 of which is shown in FIG. 1A. The receptacle 125 includes a carrying or grasping handle 150 and an appropriate key lock 140 for securing the receptacle to the enclosure. This lock 140 when engaged by the key, secures the front plate 130 of the receptacle to the sidewall 110 of the housing so that the receptacle cannot be removed from the housing except by an authorized user who has the key. And while a conventional key lock is shown, it is also considered to be within the scope of the invention to include other, alternative locking mechanisms, such as a keypad or biometrics for unlocking the receptacle 125. As noted elsewhere herein, such mechanisms may include fingerprint detectors, retina scanners or face recognition cameras and software to provide the quickest access to remove the receptacle or to access its contents.

While FIG. 1A illustrates the housing in the form of a box or enclosure, it is envisioned that the box will be securely mounted upon a wall, cabinet, desk, floor or other structure so that it is not possible for someone to try to carry off the enclosure with the secured weapon inside. Also, the enclosure is mounted in a manner so that both the front and rear sides are accessible. FIG. 1A further illustrates that in certain embodiments, cabinet 100 may include a carrying handle 105 disposed at top 120, a touch screen 115 disposed on a side wall opposite side 110, and a first button/indicator 135 and a second button/indicator 145 both disposed adjacent to touch screen 115. Further, in some embodiments, touch screen 115 may include the above-discussed keypad or biometrics for unlocking the receptacle 125. In certain embodiments, first button 135 and second button 145 may be configured to indicate a status of the receptacle 125 as locked (red light) or unlocked (green light), or the like.

FIGS. 1B and 1C illustrate the firearm cabinet 100 and receptacle 125 in an opened state (FIG. 1B) and a closed state (FIG. 1C). In certain embodiments, cabinet 100 may include a first access door 133 configured for pivotal movement about an axis from a closed position to an opened position (shown). Further, in some embodiments, receptacle 100 may also include a second access door 132 disposed proximal access door 133, where access door 132 is configured for pivotal movement about an axis from a closed position (FIG. 1C) to an opened position (FIG. 1B). In certain embodiments, access door 132 may include a knob 134 to open door 132 for easy access. Further, in some embodiments access door 133 may also include a knob to open door 133 for easy access. In certain embodiment, having two access doors (132, 133) may provide additional security when accessing a stored weapon 200. In some embodiments, these access doors may be configured to be lockable or to trigger an alarm to sound and to display on touch screen 115.

Figure 2:
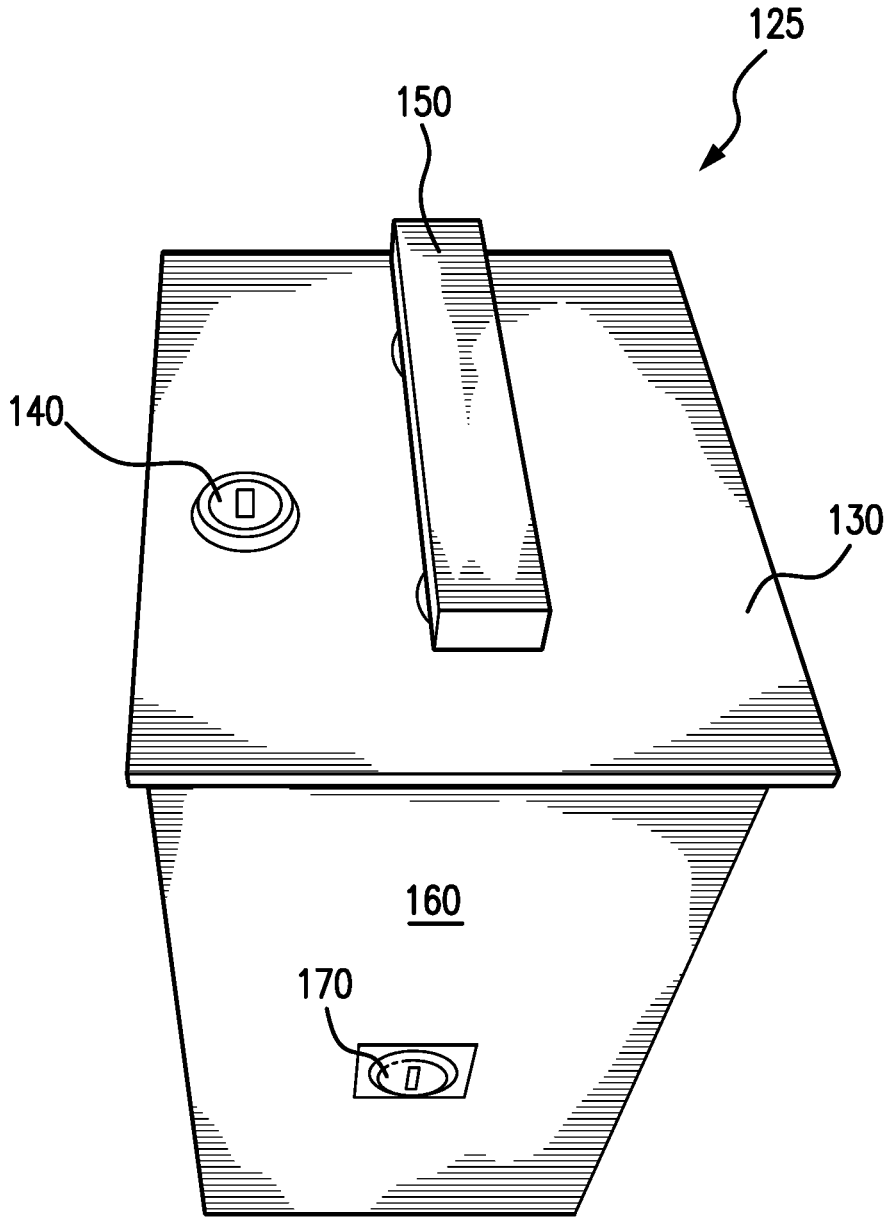
FIG. 2 is a bottom front perspective view of the receptacle that is removed from the cabinet for transport of the weapon secured therein.
Figure 3:
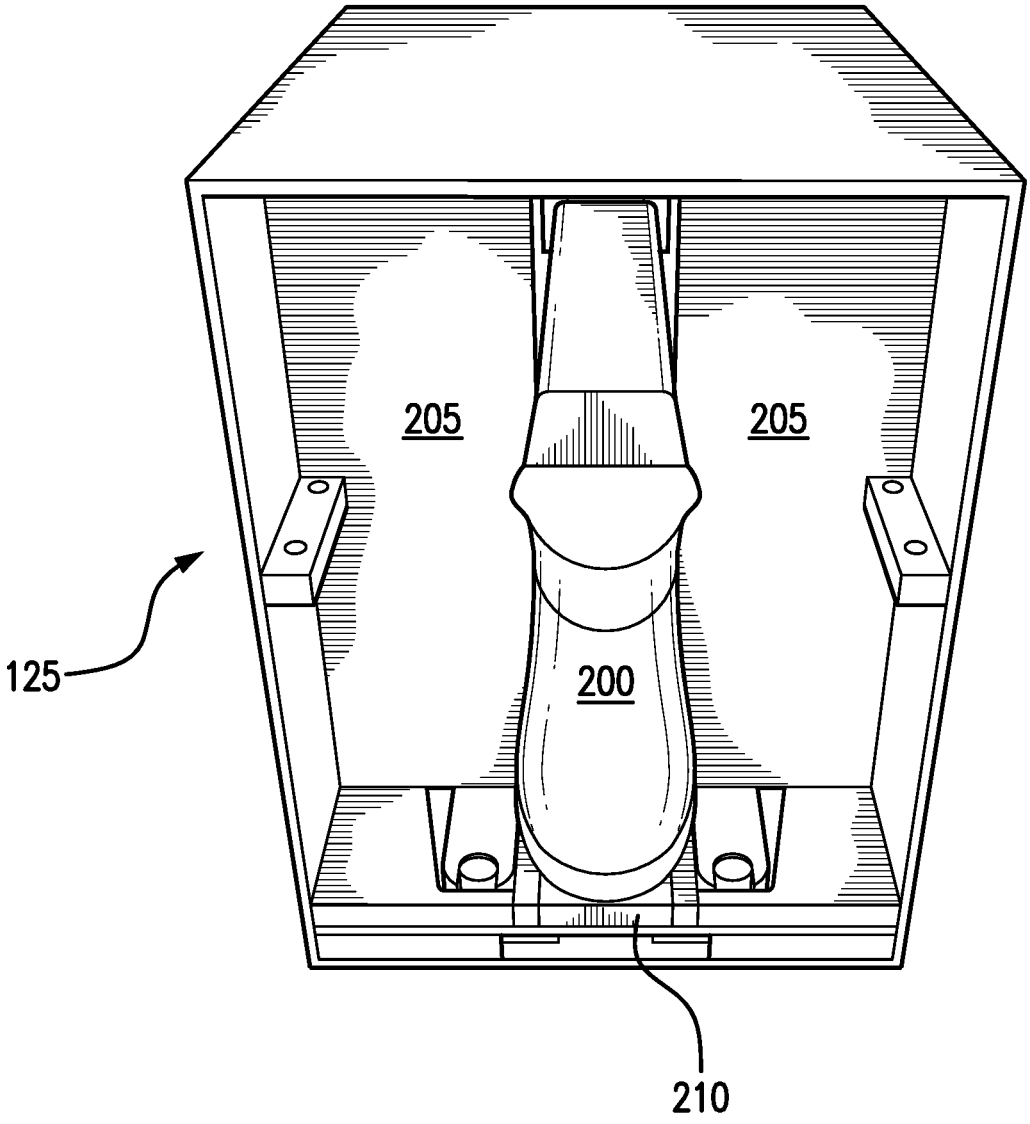
FIG. 3 is a rear view of the receptacle of FIG. 2.

FIGS. 2 and 3 illustrate the receptacle 125 of the invention after it has been removed from the housing or cabinet 100. In FIG. 2, the front face 130, handle 150, and key lock 140 are readily visible, along with a bottom or lower member that forms the floor or base 160 of the receptacle 125. Also illustrated in base 160 is a further lock 170 the purpose for which will be discussed hereinafter.

FIG. 3 illustrates the back side of the receptacle 125 with the rear plate removed so that the securement of a weapon 200 into the receptacle 125 can be more easily viewed.

Figure 4:
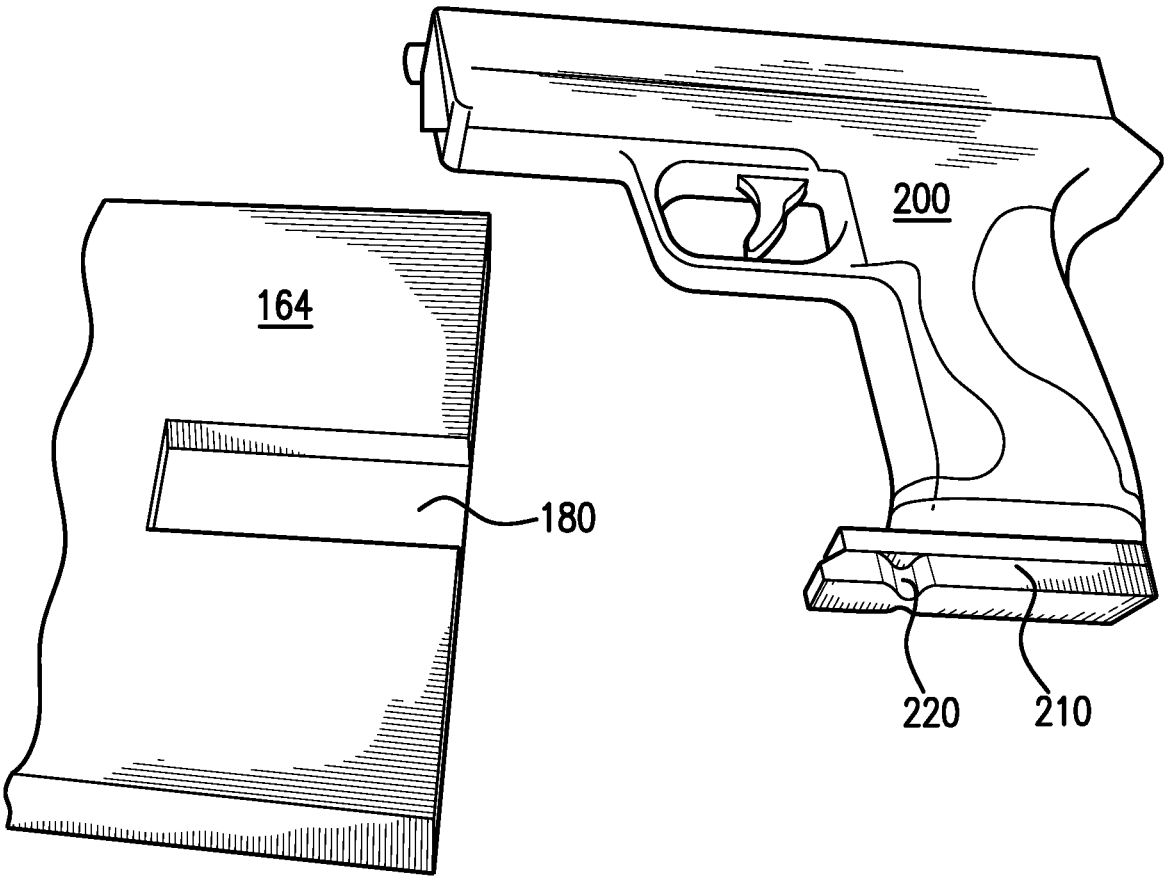
FIG. 4 is a view of a weapon with cartridge attachment and partial view of the floor of the receptacle of FIG. 2.

FIG. 4 illustrates weapon 200 in the form of a handgun to which is attached a mounting structure to 210 representing the cartridge for the weapon, or an attachable member that is provided on the weapon 200 or weapon cartridge to allow it to be received in the receptacle 125. To initially place the firearm in the cabinet, the weapon cartridge is either a separate component that is attached to the weapon or it is the cartridge itself which is capable of engaging a slot in the base of the cabinet. The weapon and cartridge or attachment is slid into the slot and into place so that it initially locks into the receptacle. This allows an authorized user to transport the weapon securely inside the cabinet with the weapon secured there in so that it cannot be accessed by others. In addition to the weapon being mounted in the cabinet, the kind that internal structure can be designed with appropriate baffles or walls that would prevent someone from reaching in and grabbing or operating the trigger of the weapon.

The upper portion of the receptacle floor is shown at 164: it includes a slot 180 which is configured to have the same width as mounting structure 210. Mounting structure 210 also includes side notches 220 which assist in securing the structure 210 and weapon 200 to the base of receptacle 125 as further illustrated in FIGS. 5 to 8A.

Figure 6:
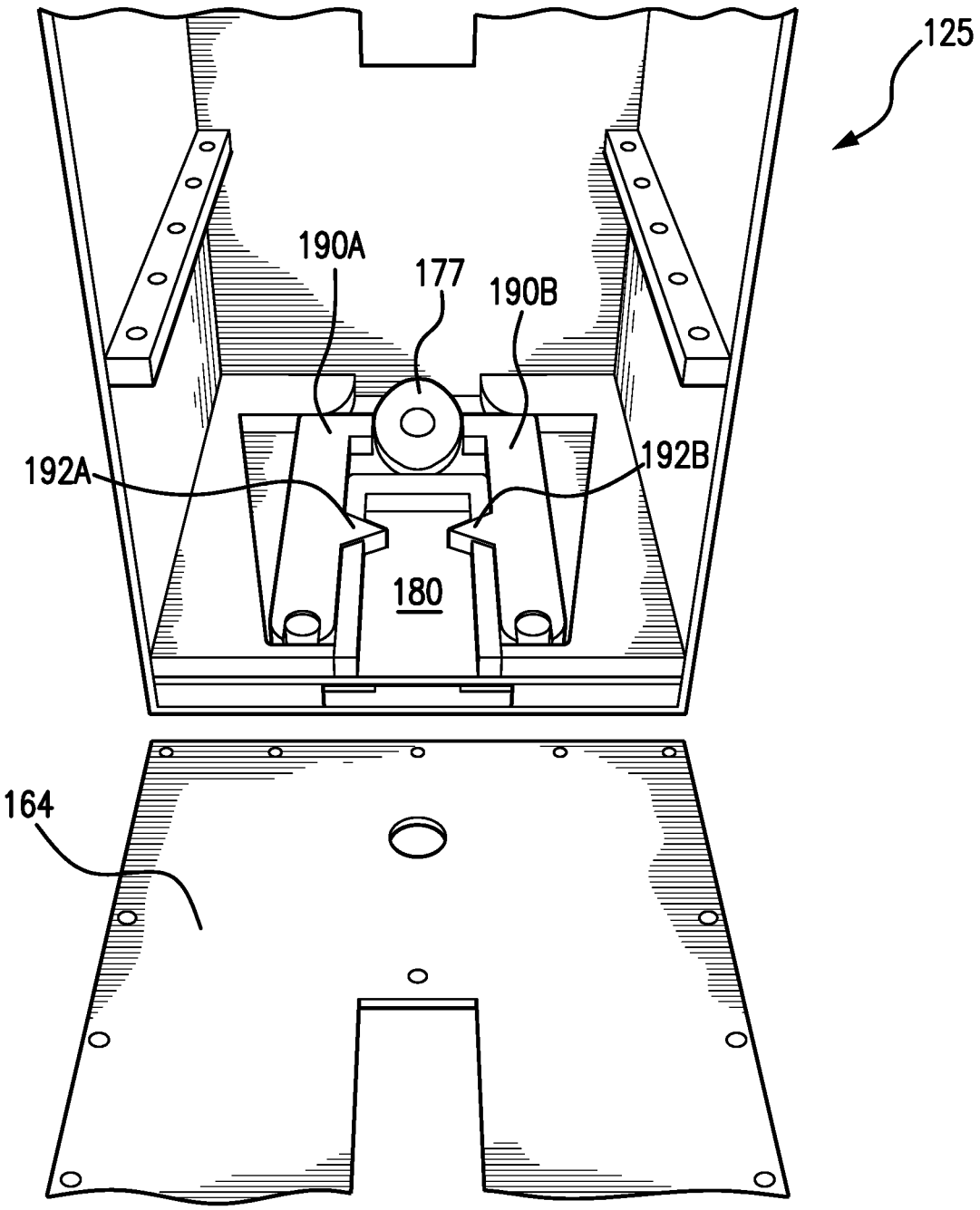
FIG. 6 is a rear view of the receptacle of FIG. 2 with the floor removed to show the locking mechanism.

The locking mechanism is best shown in FIGS. 6 to 8A. In FIG. 6, upper portion of the receptacle floor 164 is removed to further illustrate the components of the locking mechanism. FIG. 6 also illustrates the tab members 192A, 192B which engage the side notches of the mounting structure 210 to lock it in place in the receptacle. Also receptacle upper portion 164 has a narrower opening than slot 180 so that the mounting structure 210 is securely retained in slot 180 after being slid into the slot to snap lock in place.

Figure 5:
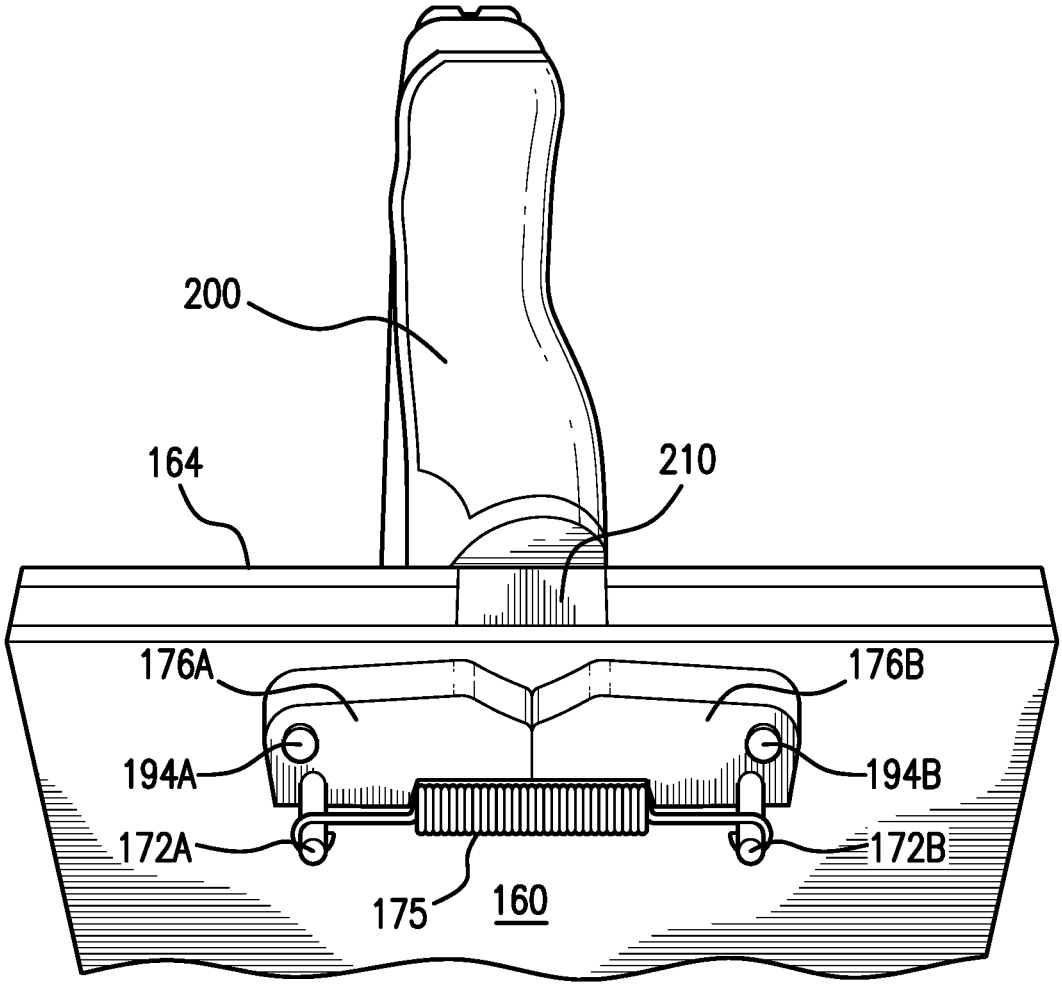
FIG. 5 is a rear bottom perspective view of the floor of the receptacle of FIG. 2 with the walls removed and showing the weapon secured thereto.

The locking mechanism includes a pair of arm members 190A, 190B secured to pivot pins 194A, 194B. These arm members can move towards slot 180 and away from it due to rotation of the pivot points, but they are biased by spring 175 toward slot 180. This is best shown in FIG. 5 where spring 175 is attached to pins 172A, 172B which are secured to arm members 190A, 190B through floor 160.

Figure 7:
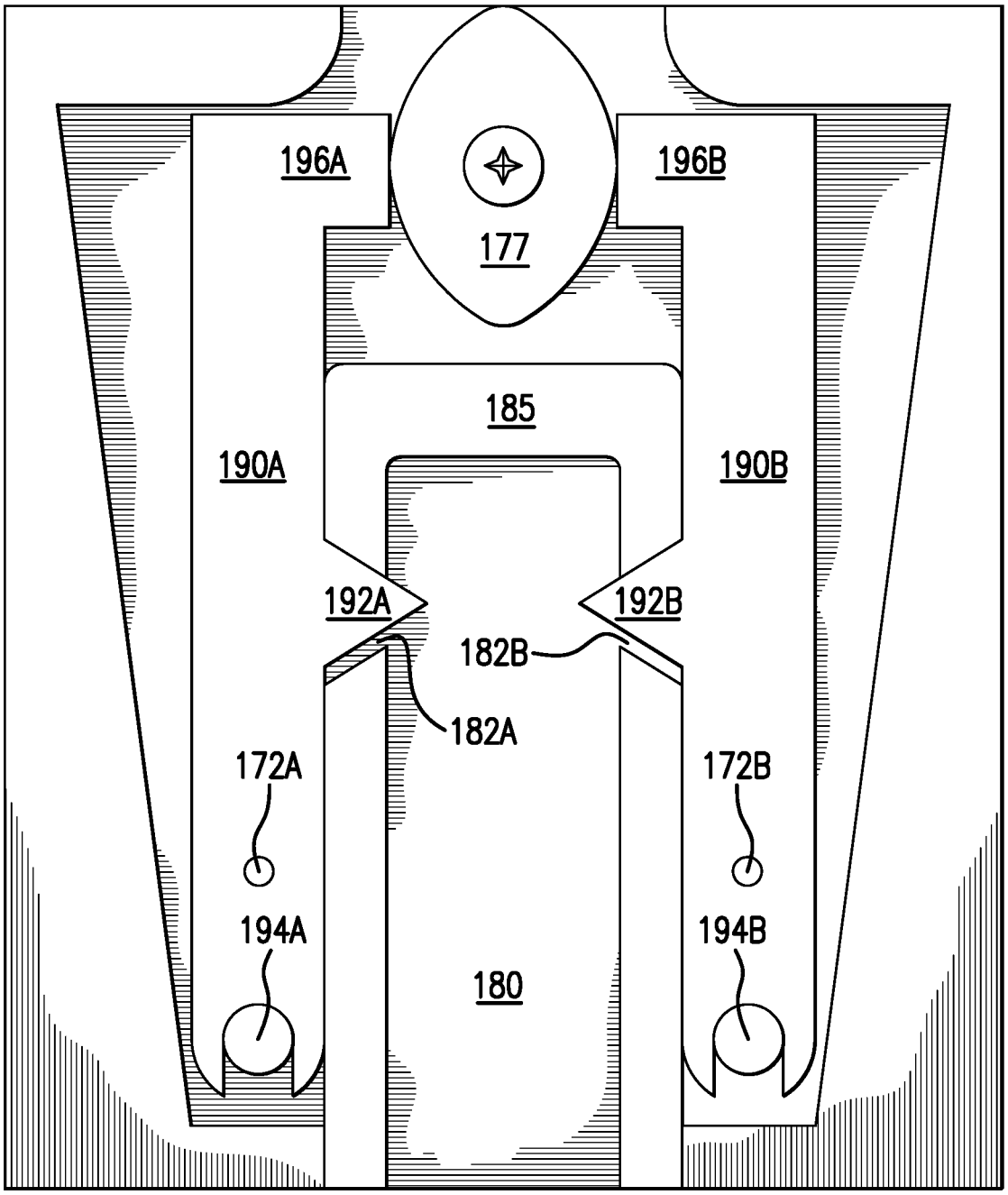
FIGS. 7 and 8A are views of the locking mechanism in the locked and unlocked positions respectively.
Figure 8A:
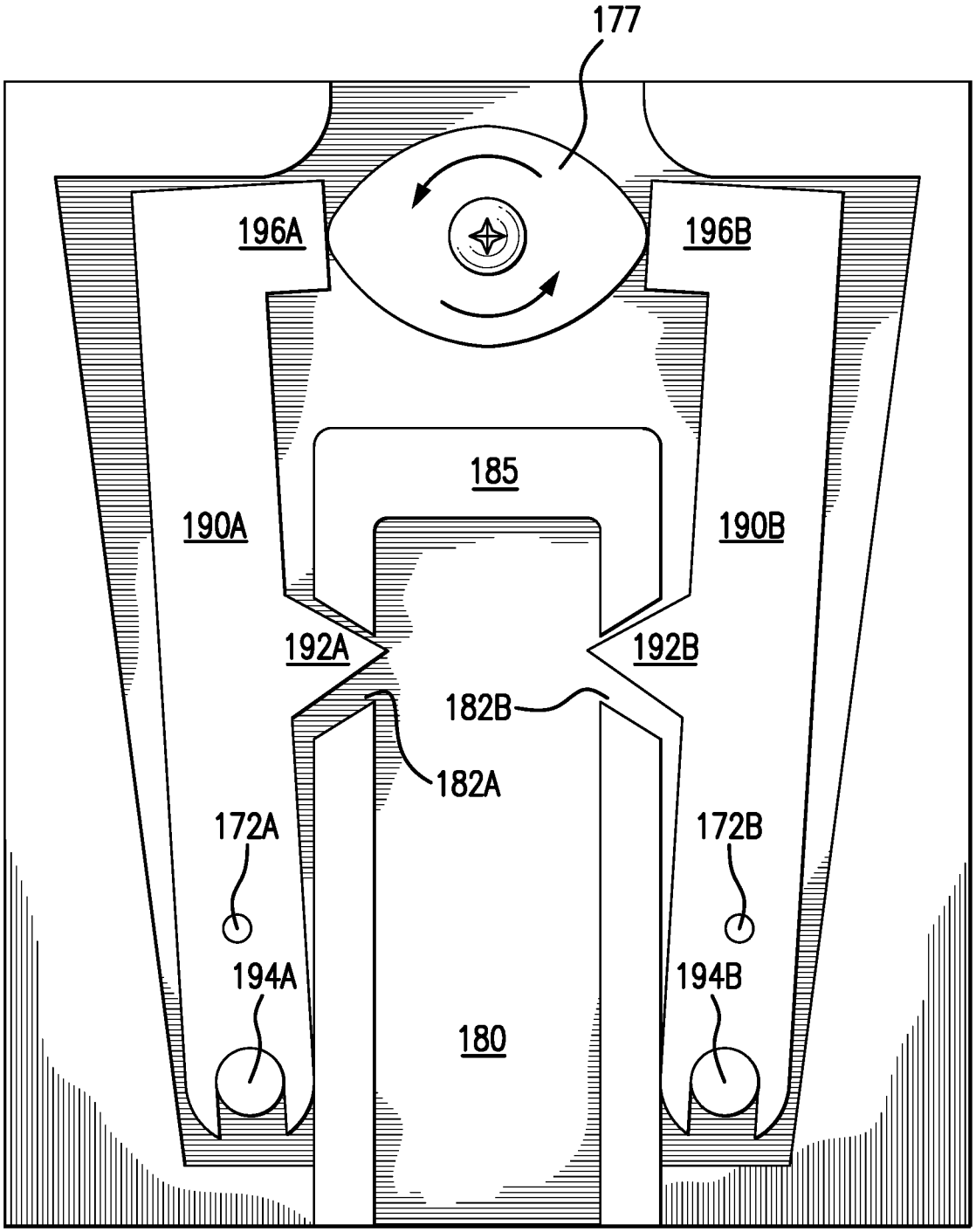

In FIG. 7, the locking mechanism is illustrated in a closed or locked position wherein the tab members protrude into slot 180 through apertures 182A, 182B in slot support structure 185, while in FIG. 8A, the locking mechanism is illustrated in an open or unlocked a position wherein the tab members are withdrawn into apertures 182A, 182B in slot support structure 185.

The locking mechanism can be moved between the locked and unlocked positions through the use of key lock 170 (FIG. 2) and disc member 177 (FIGS. 7 and 8A). Disc member 177 acts as a cam and has a wider dimension and narrower dimension about its perimeter. When this member 177 is rotated by key lock 170 to the position shown in FIG. 8A, where the larger dimensions of the disc contact ends 196A, 196B of the arm members, the spring biasing force is overcome and the tab members 192A, 192B are withdrawn into apertures 182A, 182B to unlock structure 210 from the slot.

It is also possible to lock the structure 210 in the slot by rotating disk 177 so that the thinner areas contact arm member ends 196A, 196B to urge tab members 192A, 192B to into apertures 182A, 182B to engage the notches 220 of structure 210 to lock it in the slot. This is illustrated in FIG. 7.

The locking of mounting structure 210 and weapon 200 in slot 180 is the default position when the receptacle 125 is removed from the enclosure. This allows the weapon to be transported in a secure cabinet by authorized personnel such that the weapon cannot be removed from the cams it without the appropriate lock releasing mechanisms. Thus, the weapon and its cartridge can be safely and securely transported from one point to another. It is also possible to include in the receptacle structure at the additional wall members or trigger engaging locks to prevent accidental or unintended discharge of the weapon as it is transported.

As shown in FIG. 3, the rear part of the receptacle is generally open when it is stored inside the enclosure, but for transport, an additional plate 205 can be temporarily secured or locked onto the open rear of the receptacle to conceal the weapon therein.

Once the weapon cartridge or support is locked in place, it can only be removed from the receptacle by turning the disk so that the larger portions push against the ends of the arms and move them outwardly so that the protrusions are retracted from the apertures. This releases the lock. And as noted sliding the cabinet into a wall mount or other supporting structure allows a tab member to engage a pair of shorter flap members which are linked to the lower parts of the arm member to pivot them out of position so that the protrusions do not engage the apertures and lock the cartridge to the cabinet. This allows the weapon to be available in the cabinet after the cabinet is placed in the wall or support structure.

As described above the weapon would be maintained securely in slot 180 during transport or movement of the receptacle 125. When the receptacle is slid into the housing or enclosure, it is not desirable to maintain the weapon secured to the slot since that would delay access to the weapon when necessary. There is also no need to lock the weapon in the receptacle because the receptacle is locked in the enclosure. As noted herein, the opposite side of the enclosure has one or two access doors to allow an authorized user to quickly access the weapon when needed.

The weapon cartridge would be separate from the receptacle or enclosure but it is primarily intended to hold the weapon safely during transportation and handling of the receptacle. This would be done by providing the receptacle to be transportable. After delivering the weapon to the desired location, the receptacle would be inserted into the enclosure and secured thereto so that the weapon can be released in the cabinet so that it can be accessed through the access doors. If a supervisor had to remove the weapon they would remove it differently from how the user would access it. For example, if a substitute teacher was going to teach a certain class that had a firearm in the box and they didn't want to use a gun but they wanted to use pepper spray, the supervisor could insert a key to turn the lock to release the cartridge with gun and replace it with, e.g., a cartridge that had pepper spray in it. This is so the supervisor is not walking down the hall with a gun in hand after he or she did the exchange. This guarantees keeping the weapon in lock down. The weapon can only be handled outside the cartridge when using a special tool to remove it from the cartridge so if the supervisor didn't have a tool they could only walk with the receptacle in hand without showing the weapon.

An additional feature of the invention allows the weapon 200 and structure 210 to be released from the notch 180 when the receptacle is secured to the enclosure. As best shown in FIG. 5, this release structure includes pivot pins 194A, 194B that are operatively associated with and connected to flap members 176A, 176B. When the receptacle is slid into the enclosure, these flap members are contacted by a fixed rod in the enclosure which causes the flap members to turn the pivot pins 194A, 194B. This in turn overcomes the biasing force of the spring 175 which causes the arm members (see FIG. 8A) to withdraw the tab members from the apertures. Therefore, the weapon is not secured to the receptacle so that it can be quickly retrieved when accessing the receptacle interior from the doors on the back of the enclosure.

Figure 8B:
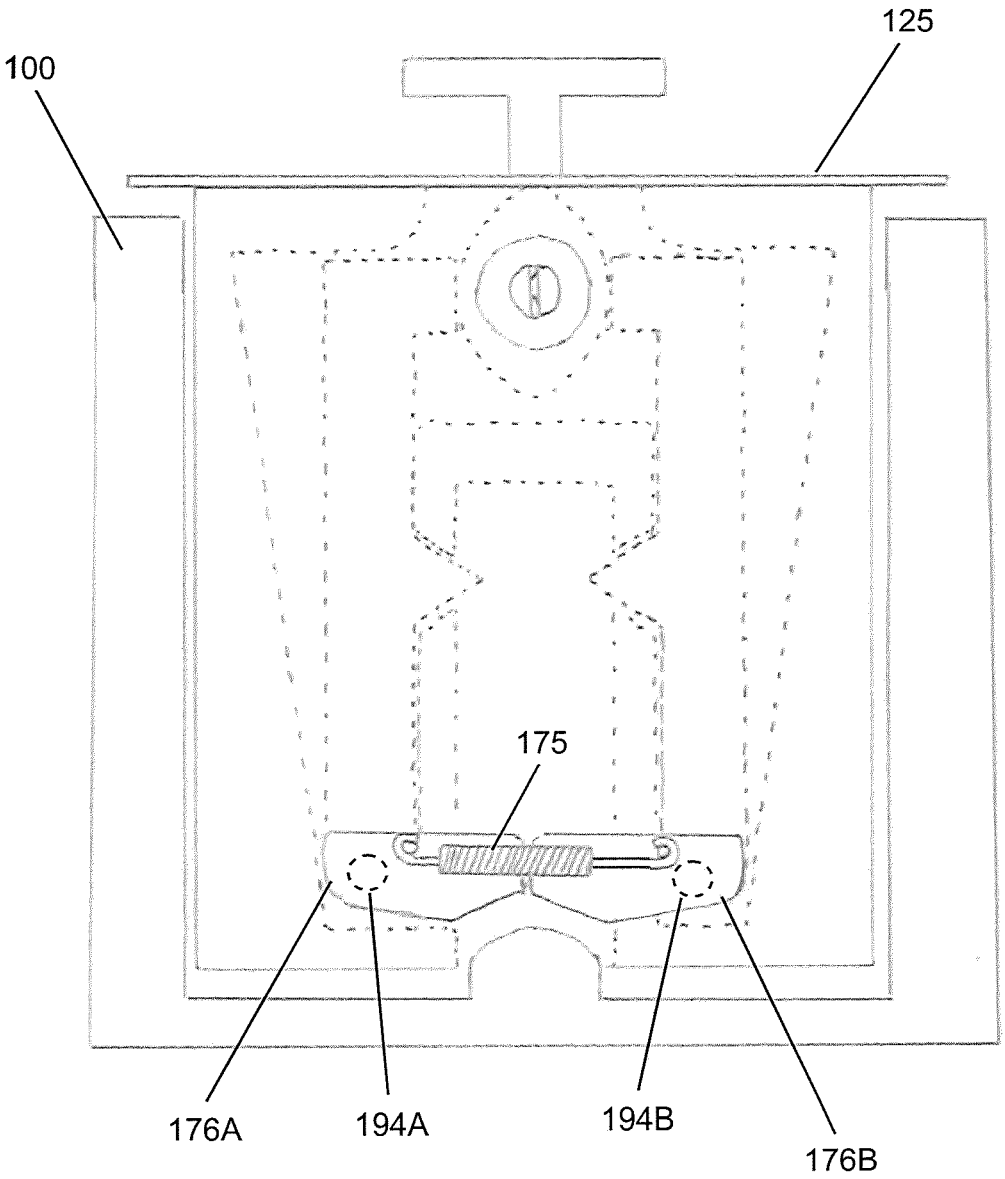
FIGS. 8B and 8C are bottom views of the receptacle showing the locking mechanism in the locked and unlocked positions respectively.
Figure 8C:
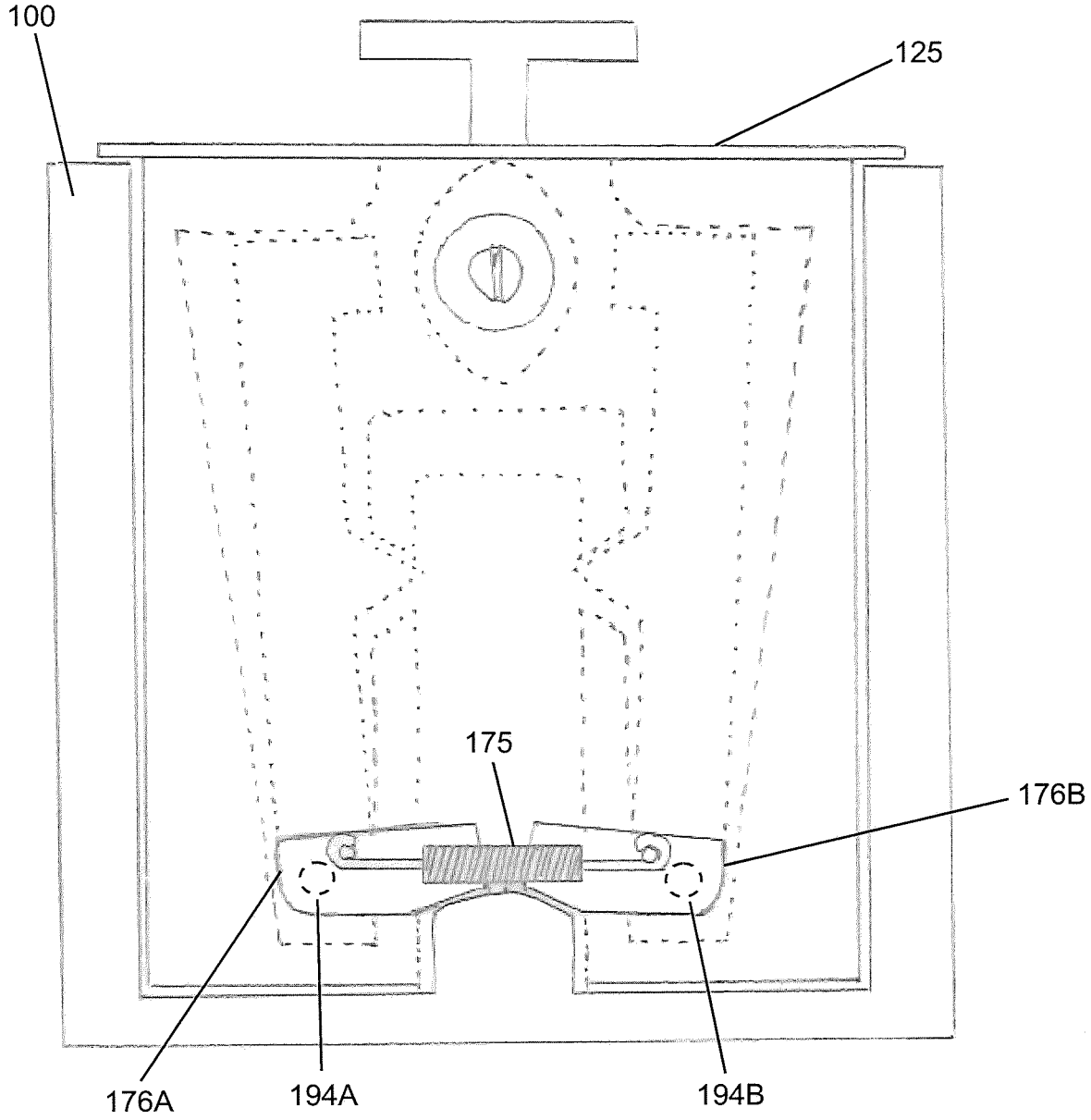

FIGS. 8B and 8C illustrate the release structure on the bottom of the receptacle in the closed and open positions, respectively, after the receptacle 125 has been inserted into the housing 100 has pivot pins 194A, 194B are securely attached to both the flap members 176A, 176B and the arm members 190A, 190B (see FIG. 8A). This can be done by using screws, other fasteners or an adhesive when the parts are made of wood, or by welding or brazing when the parts are made of a metal such as steel or aluminum. In these two figures, the disc member 177 is shown in phantom in the usual position that would allow locking of the tabs 192A, 192B to securely hold the weapon in the receptacle. In FIG. 8B, the tabs are in a locking position, while in FIG. 8C, the flap members have been moved to cause the pivot pins to rotate to move the tab members while also overriding the spring 175 so that the tabs are unlocked to allow the weapon to be removed from the receptacle.

As it is possible for someone to tamper with the flap members to release the weapon when the receptacle is in transit, a wall member is provided to close off the back area of the receptacle. A further panel (not shown) can be provided below the flap members so that when the receptacle is in transit, the flap members are not visible so that they can securely hold the weapon in the receptacle. The further panel can be removable to facilitate returning the receptacle to the enclosure after transport is completed.

When the receptacle is secured to the enclosure, it can be accessed through one or two doors that are provided on the back of the enclosure. As in the copending application, access to the interior can be made through a dual button activation system. To open the first door one button is pushed after access by use of a key, keypad, or biometric pad. At this point there is an additional plate or door which prevents direct access to the weapon until after a further button is activated. And as noted in the prior application, activation of the second button also activates video and audio in the room so that monitoring personnel can determine whether and how the disturbance may be escalating.

The access doors include two buttons 135, 145 so that the first one can send a signal that something out of the ordinary is happening in the room while the second button is activated to access the weapon or firearm in the cabinet and indicate that the situation is becoming an emergency. The invention assumes that an authorized person would be able to initially open the outer door of the cabinet based on a remote keypad or biometric device that is unique to the authorized user, or the code to which is known only to the authorize user. For example, in a school setting, the initial access by the teacher would activate a video camera in the room while also sending a message to a monitoring station or the principal's office so that the disturbance on the room can be monitored. At that point, the principal or monitor can check in with the authorized user to make sure that the situation is coming under control or that further actions are appropriate.

The invention is also operable with a smart weapon or smart weapon cartridge that would communicate with the monitoring station after being withdrawn from the receptacle. As an example, if the authorized user does not respond to the principal, the principal can disable the box or disable the smart gun inside the box so that the teacher cannot use it inappropriately or further such that an intruder or other bad actor either cannot access the weapon or cannot use it even if the weapon is accessed. For this, the receptacle would have electronics that wirelessly communicate with the gun such that the smart gun can be disabled even after it is removed from the receptacle.

The access doors can include two buttons that can be activated to access the weapon or firearm in the cabinet. The invention assumes that an authorized person would be able to initially open the outer door of the cabinet based on a remote keypad or biometric device that is unique to the authorized user, or the code to which is known only to the authorize user. For example, in a school setting, the initial access by the teacher would activate a video camera in the room while also sending a message to a monitoring station or the principal's office so that the disturbance on the room can be monitored. At that point, the principal or monitor can check in with the authorized user to make sure that the situation is coming under control or that further actions are appropriate. For example, if the authorized user does not respond to the principal, the principal can disable the box or disable the smart gun inside the box so that the teacher cannot use it inappropriately or further such that an intruder or other bad actor either cannot access the weapon or cannot use it even if the weapon is accessed. For this, the support plate would have electronics that wirelessly communicate with the gun such that the smart gun can be disabled even after it is removed from the cabinet.

Although shown in FIGS. 1-8 of the drawings as a wood prototype, the cabinet itself would preferably be a metal box with mechanisms to operate it. The design of a box with a certain size, predetermined workflow functionality through mechanisms and aesthetics making it correct in design for the best solution for the desired kind of use. The compartment box has better functionality geared toward accessing compartments in a certain manner with provisions to mount cameras, microphones and electronics to it. If a person was in a situation to access a compartment he/or she could access the compartment in a safe predetermined workflow. This box design would be designed so that electronic sensors can mounted a later time. For this, an electronic module can be provided that would have sensors connect to it. This module would have an embedded chip with software that would allow sensor data to be read by an app running on a phone, tablet or watch via Bluetooth or the internet. This module would have provisions for all different kinds of inputs. The preferred design is for a firearm as a compartment box because accessing the box in a safe manner is primary while the contents of the box are a secondary consideration.

For example, if a rogue supervisor wanted to access a weapon and use it they could not access it unless they had the cartridge installed in the firearm box or had a special tool. This is so that the weapons can be sent to authorized handlers for inspection or routine maintenance and be safe from wrong use during transport. When the authorized handlers receive the cartridges they would use a special access tool to remove the weapon. If a superintendent at a school district deployed this whole system across multiple schools he or she would know that the only time a weapon is exposed outside the cartridge is when a user deployed it through the firearm box or when the cartridges are sent to handlers for maintenance. This cartridge/cabinet combination significantly increases the safety of the stored weapon.

The firearm cabinet is operatively associated with a weapon cartridge. This has a key lock to engage the lock pins to lock the weapon into place. If the weapon does not have a properly configured cartridge, a structure can be attached to the cartridge to perform that function. It is envisioned that weapon cartridges can be designed to be operable with the present cabinet as the size of the slide lock and other components can be tailored to the sizes of the various weapon cartridges.

The firearm cabinet is provided with the weapon as follows:

The weapon is loaded into weapon cartridge so it clicks in place (i.e., it locks in place by a lock mechanism in the cartridge). At this point the weapon cannot be removed out of the cartridge because the locking mechanism is in place. If a person wanted to remove the weapon at this point they would need to use a special tool.

The weapon cartridge is installed in the slide lock in the firearm cabinet. A key is inserted into the key hole of the bottom lock and is turned to actuate the protrusions or locking pins to secure the cartridge in place in the cabinet. The cabinet can now be used to safely transport the weapon.

After the weapon is returned to the room, the cabinet is placed in a wall mounting or other opening for storage of the weapon in the room or location. The weapon lock mechanism in the cartridge is automatically disengaged when the cartridge is locked down in the cabinet as described herein. This allows the weapon to be freely removable from the cabinet and removed at the end that has the access doors after those doors are opened by an authorized user who has possession of the applicable codes.

Alternatively, the weapon lock mechanism can be engaged by inserting the key in the bottom lock to unlock the arm members so that the cartridge is free for removal of the weapon from the cabinet.

Another unique feature of the box is that it can include sensors that would be activated when the box is activated. This technology would report the activity of what occurs at the box through the monitoring of sensors which can be installed at points on the area or object being secured. The sensors would be wired to a small box mounted on the device being monitored. Each sensor would plug into the small box/module and the box would communicate over the web to a cloud. Each box would not have to be linked to a local server. This is in effect a small box/module that has several female plugs that allow to have multiple devices plugged into it to be monitored over the net via an app for an iPhone, watch, tablet or computer. This module would use sim card technology for authentication to cloud and Bluetooth for local communication to local electronic devices such as speakers or other sound generating devices that provide audible alerts, beeps, sirens, or tones.

Another embodiment of the invention relates to a weapon or weapon cartridge that mounts on a wall plate. The weapon or weapon cartridge has electronics in it. The wall plate would house the biometrics or a keypad on front side. The system would have software in a computer that would control functions of the wall plate that holds the cartridge with the gun. The software from the computer would have the ability to send information to the wall plate, on through to the cartridge, and into the cartridge. Alternatively, the gun can be a smart gun that has its own electronics that operate similarly. The wall plate would have the ability to wirelessly talk to the cartridge or smart gun after it was deployed. This feature is important because if a registered user decides to go rogue or if the weapon falls into the wrong hands then the monitor or administrator can have the ability to disarm the user or smart gun.

Figure 9:
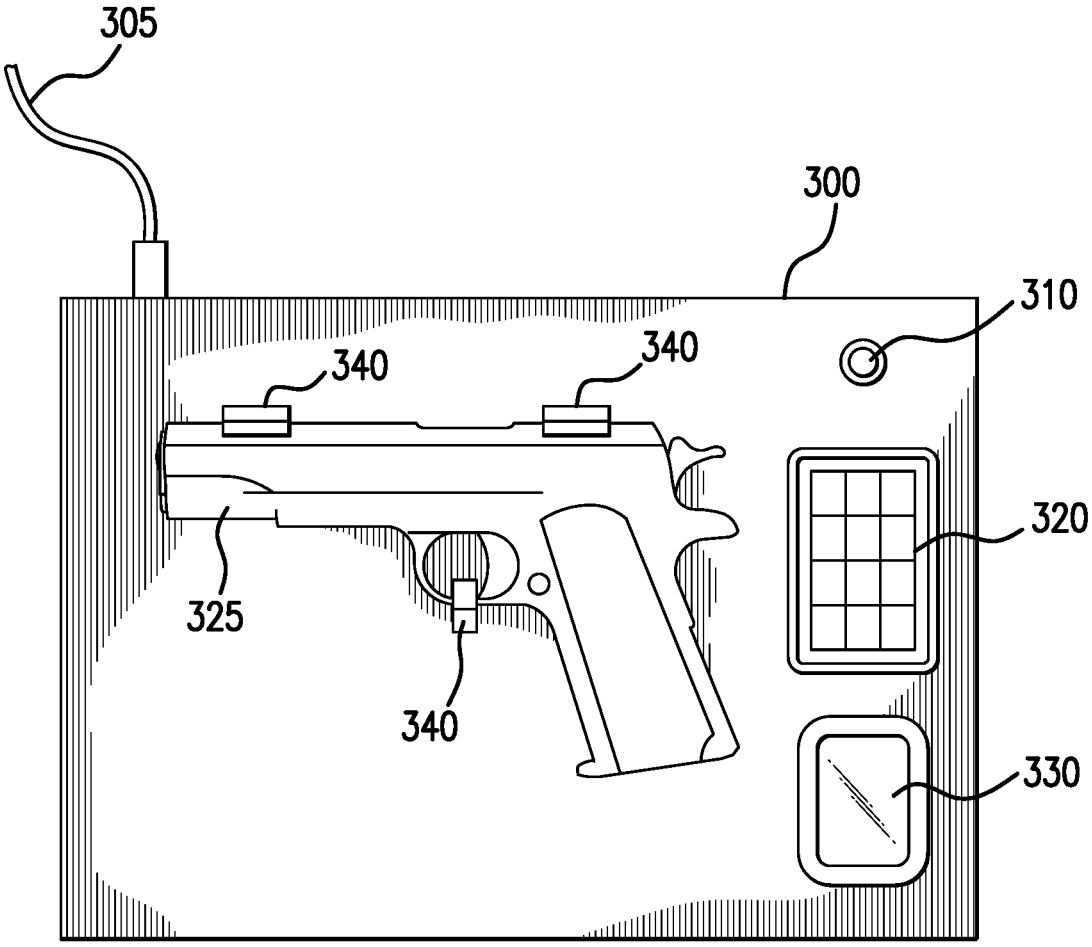
FIG. 9 is a schematic illustration of one wall plate for securely mounting and holding a weapon thereon.

FIGS. 9 to 12 provide variations of mounting of a gun or smart gun 325 to a wall plate. FIG. 9 illustrates a wall plate 300 that includes electronics (a red button 310, keypad 320 and biometrics 330) and that includes a claw or claws 340 to grip the gun 325 and hold it in place on the wall plate 300. In some embodiments, electronics (a red button 310, keypad 320 and biometrics 330) may be electrically connected via a computer link or communications line 305 to a computer of communications system.

Figure 10:
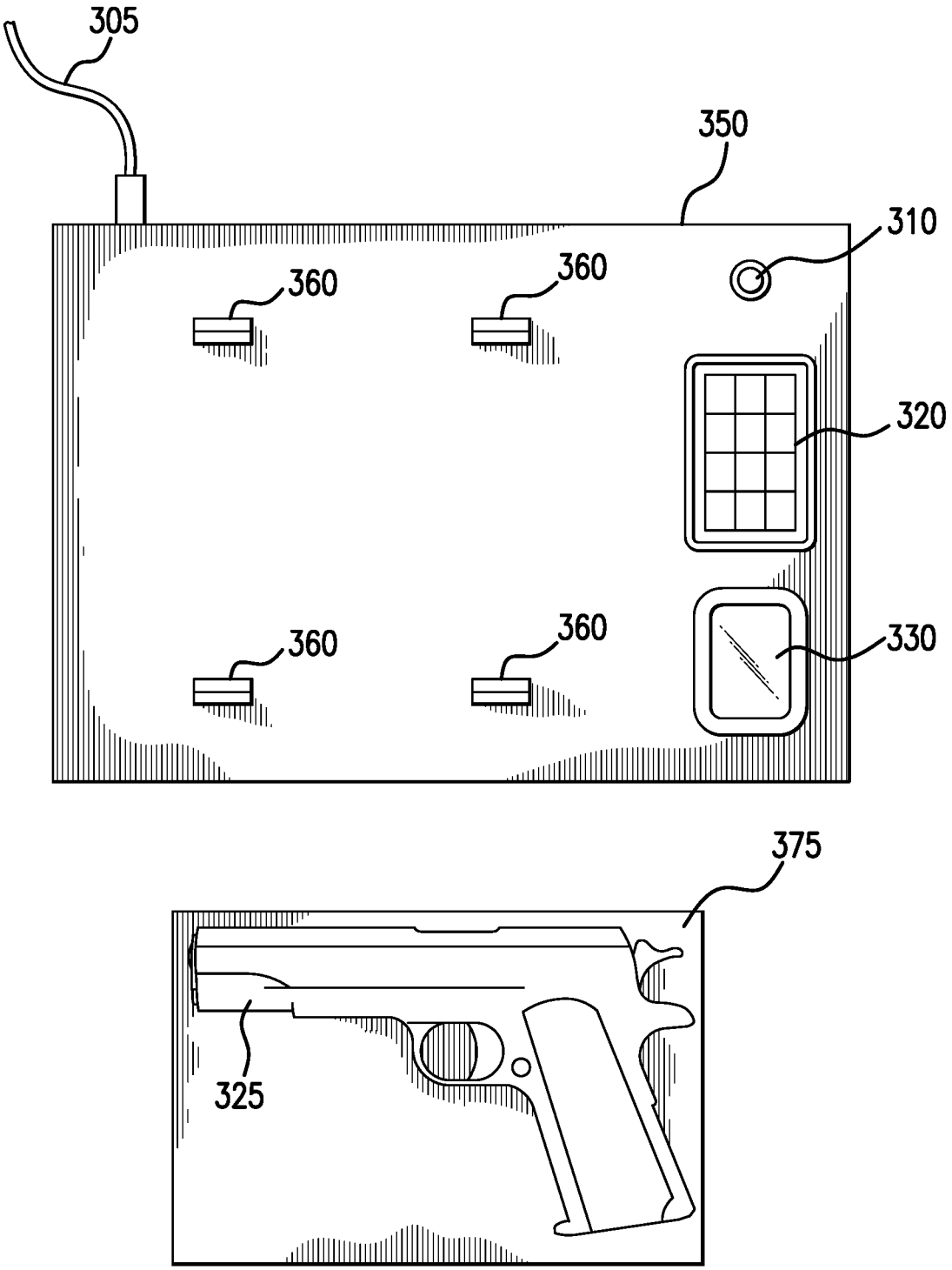
FIG. 10 is a schematic illustration of another wall plate for securely mounting and holding a weapon thereon.

FIG. 10 shows another wall plate 350 that includes a snap locking mechanism 360 that attaches a gun 325 mounted on a gun cartridge or immobilization plate 375 by engaging a corresponding mechanism. Again, the wall plate 350 has electronics (a red button 310, keypad 320 and biometrics 330) that holds the gun cartridge or immobilization plate 375. In certain embodiments, electronics (a red button 310, keypad 320 and biometrics 330) may be electrically connected via a computer link or communications line 305 to a computer of communications system.

Figure 11:
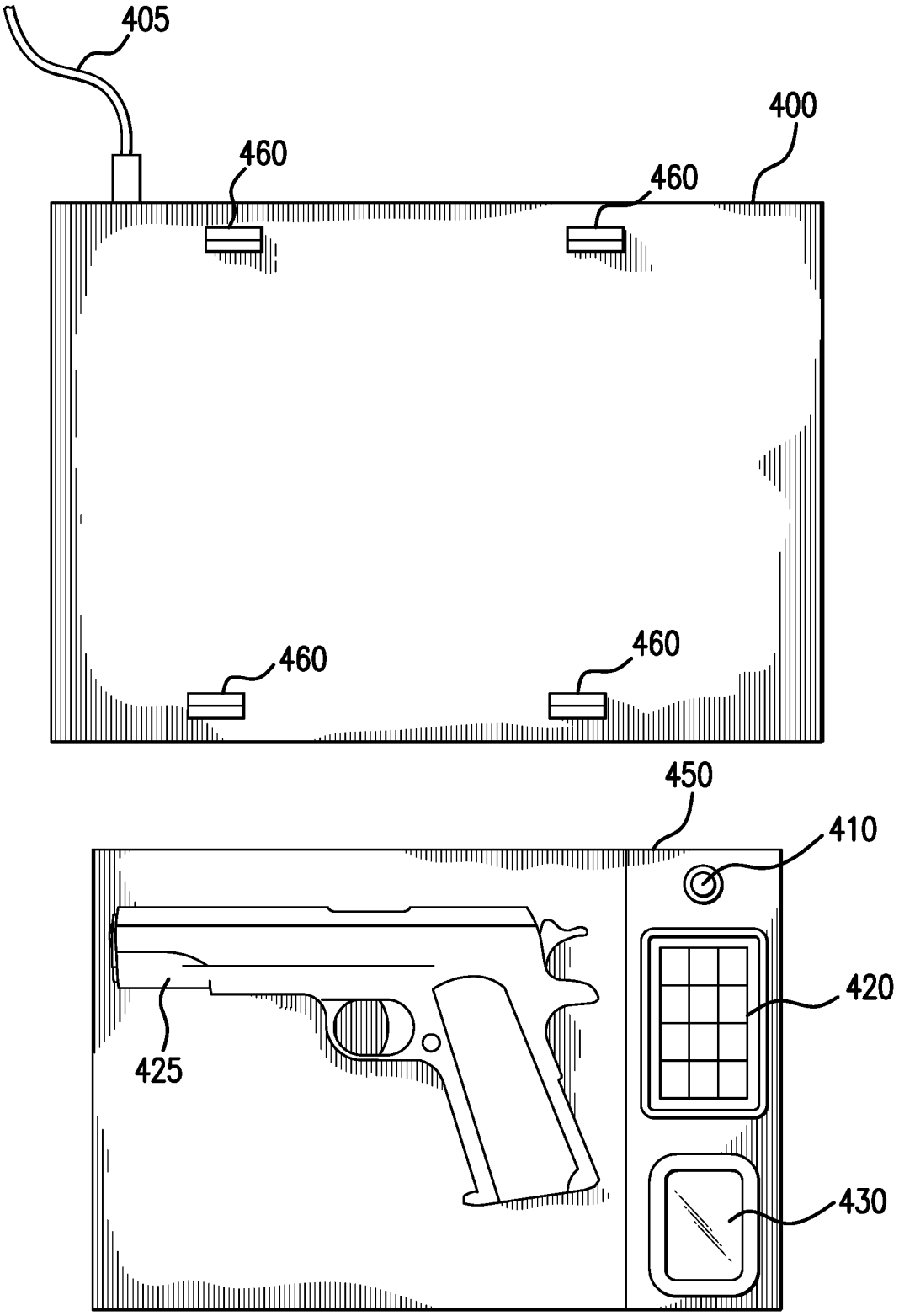
FIG. 11 is a schematic illustration of a further wall plate that secures a weapon mounted on an immobilization plate thereto.

FIG. 11 is yet another wall plate 400 with a snap locking mechanism 460 that allows a cartridge or immobilization plate 450 with electronics (red button 410, keypad 420 and biometrics 430) thereon to be mounted on the wall plate 400. In certain embodiment, gun 425 may be mounted to plate 450 by engaging a corresponding mechanism. In some embodiments, electronics (a red button 410, keypad 420 and biometrics 430) may be electrically connected via a computer link or communications line 405 to a computer of communications system.

Figure 12:
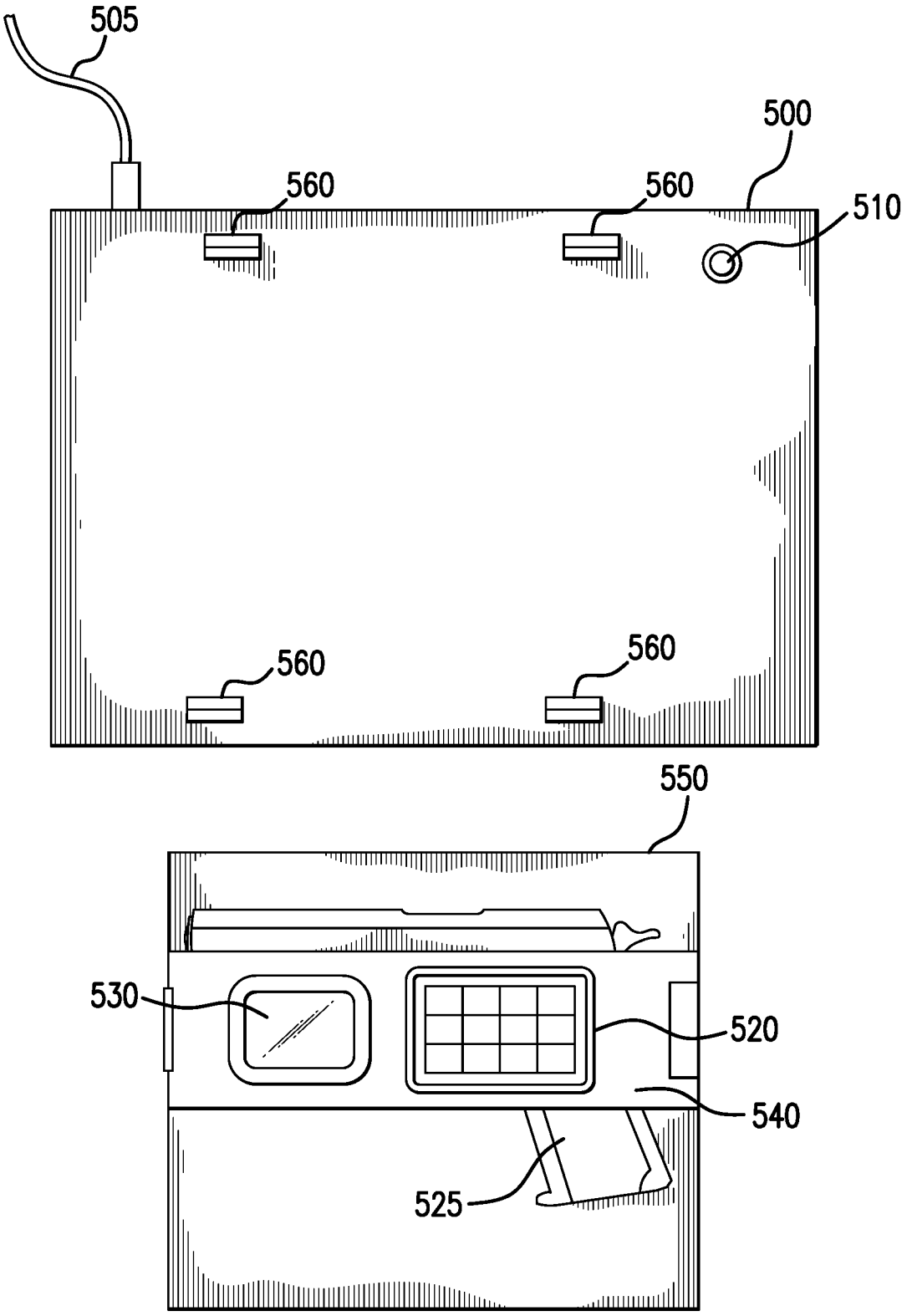
FIG. 12 is a schematic illustration of an alternative wall plate that secures a weapon mounted on an immobilization plate thereto.

FIG. 12 is another wall plate 500 similar to that of FIG. 11 and having a snap locking mechanism 560. Wall plate 500 has red button 510 but the gun 525 or gun cartridge or immobilization plate 550 includes keypad 520 and biometrics 530 disposed on a mounting plate 540 configured to envelope gun 525. These would be activated when the gun, cartridge or immobilization plate are removed from the wall plate. In some embodiments, keypad 520 and biometrics 530 may be electrically connected via a computer link or communications line 505 to a computer of communications system.

Another use of the invention would be that the cabinet or wall plate can send information regardless whether the situation is an emergency or not. A cabinet and mounting module could be used e.g. by plugging a guitar or instrument into it. The box would allow a user to communicate their work to the cloud for someone else to monitor or review. A website could be available for users such as a music teacher reviewing play of music or a composition. This box can be used to monitor construction from a supervisor and to link it back to a website or the cloud for the user to go back and retrieve at a later time. The box with inputs would be capable of triggering devices to do things from a remote location. The user could initiate a command from a phone, tablet, watch or other mechanism wherein the device is plugged into another box or module. The guitar or other input could be used as a code to access the box or to operate something at the remote location. For example, if someone had a storage building in California and wanted to open it remotely with the sound of a guitar cord played, the connections between the boxes communicating back and forth would allow it.

Additional features of the invention are provided by the box itself with regard to its size, shape, color and types of functions of work flow to provide safe access with alerts from the operation of mechanisms to access the internal compartment. The activation buttons can also be used to activate sirens, doors, keypads, other rooms or compartments, lights or other related functions or mechanisms.

As the box would not have any signals to transmit wired/wirelessly from any cameras or transmit signal taking from a mike, it would just send audible alerts through a speaker with flashing text on a LCD screen and have bright flashing lights on top of the box for viewing for the deaf. This box would have provisions for mounting all kinds of sensors. The compartment box would have an onboard speaker connected to an electronic circuit board that creates an audible alert when triggered and same with text. The compartment box would have a battery for use when power is out but would typically be hard wired for continuous power. The mechanisms can still work opening doors without having any power battery/electrical as well as no sirens or flashing text. The siren when having power can be loud enough to be heard nearby.

Yet another feature of the invention is a detection system which can be added to the previously disclosed firearm box. This detection system includes a detection device that is wirelessly connected to a detectable collar, ankle bracelet, chip that is worn on or by an unauthorized person. As that person comes into range of the detection device that is associated with the firearm box, an alert is triggered by the detection device. For example, if there are areas where the firearm box is located and this area is off limits to people such as felons, mentally ill, suspected terrorist or registered sex offender, the detection device will read the detectable collar, ankle bracelet, or chip and send an alert that signifies the presence of the unauthorized person. This system would be triggered when the unauthorized or restricted person is in proximity of the sensors of the detection device. If desired, sensors would be installed at the front door, in the yard, or in another area of interest such as by a school or government building. Although wireless sensors are preferred, the sensors can be hard wired instead depending upon the configuration and age of the building. As the system is triggered, alerts are send to owners of the firearm box or of others who would need to know of the presence of such unauthorized person. For example, a mother of a child at a school could be notified at work that a felon, mentally ill person, suspected terrorist or registered sex offender is in proximity of the school as measured by the device that is present in the firearm box and that scans a perimeter which is the sensor area.

Additionally, a firearm security system and access lock can be provided on the weapon that is maintained in the firearm box.

This firearm security system would be similar to that described in Torii U.S. Pat. No. 5,598,151. This security system is provided for the containment of at least one firearm in the firearm box and it operates in conjunction with an alarm system adapted to generate a signal upon the emergency opening of the repository indicative access to and removal of the firearm contained therein. The alarm system generates a signal at a remote location that is indicative as to whether the weapon in the firearm box has been accessed and/or removed in an intended manner, such as by a criminal that overpowers the person that has authorized access to the firearm box or when the weapon is removed under emergency and/or duress conditions. The Torii patent also discloses arrangements of electronic components to carry out this monitoring of the movement of the weapon. When used in conjunction with the other features of the invention, it becomes easy to determine where the weapon is located so that backup or reinforcement personnel can be quickly deployed to the appropriate area to provide assistance or defense.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A firearm receptacle having an open interior and comprising:

a locking device associated with the interior of the receptacle for engaging an insertable structure that is attached to or forms part of a handle of a firearm, the locking device including a locking mechanism having a first position which engages the insertable structure to securely hold it in place within the receptacle and a second position wherein the locking mechanism is out of engagement with the insertable structure, the locking mechanism comprising male or female portions one of which is present in the receptacle and the other of which is associated with or forms part of the insertable structure;

biasing means for fixing the locking mechanism in the first position; and means for overriding the biasing means to move the locking mechanism to the second position wherein the insertable structure can be freely removed from or inserted into the locking mechanism, wherein the firearm is a handgun having a handle the bottom of which is releasably mounted onto the insertable structure, wherein the insertable structure has a width that is no larger than that of the handgun handle.

2. The firearm receptacle of claim 1, wherein the locking mechanism includes first and second arm members each having a protrusion or tab member that engages a mating aperture in the insertable structure when the locking mechanism is in the first position, and the biasing means comprises a spring which is operatively associated with the arm members to urge them toward each other and toward the first position.

3. The firearm receptacle of claim 2, wherein the means for overriding the biasing means comprises a rotatable cam member that is operatively associated with the arm members, the cam member having arm contact portions of different sizes, wherein, when the cam member is rotated, contact portions of larger dimensions contact the arm members to move them out of engagement with the insertable structure and into the second position.

4. The firearm receptacle of claim 3, wherein the rotatable cam member is operatively associated with an external key lock so that a key inserted into the key lock can be used to rotate the cam member to move the arm members out of engagement with the insertable structure.

5. The firearm receptacle of claim 2, wherein the means for overriding the biasing means comprises flap members connected to the arm members through a pivot rod so that movement of the flap members also moves the arm members to overcome the biasing means and urge the arm and tab members to the second position.

6. The firearm receptacle of claim 1, which is rectangular in shape, and which includes a door for access to the receptacle interior.

7. The firearm receptacle of claim 6, wherein the door can be opened by a biometric unlocking mechanism, a key pad, or a key.

8. The firearm receptacle of claim 1, wherein the receptacle includes a trigger engaging lock to prevent accidental discharge of the handgun when being transported.

9. A lockable firearm cabinet comprising:

a housing having outer components surrounding an interior with the outer components including a base, one or more walls and a top; and a firearm receptacle having an open interior and comprising:

a locking device associated with the interior of the receptacle for engaging an insertable structure that is attached to or forms part of a handle of a firearm, the locking device including a locking mechanism having a first position which engages the insertable structure to securely hold it in place within the receptacle and a second position wherein the locking mechanism is out of engagement with the insertable structure, the locking mechanism comprising male or female portions one of which is present in the receptacle and the other of which is associated with or forms part of the insertable structure;

biasing means for fixing the locking mechanism in the first position; and means for overriding the biasing means to move the locking mechanism to the second position wherein the insertable structure can be freely removed from or inserted into the locking mechanism, wherein the housing receives the receptacle as a drawer that can slide into the housing, and wherein the sliding of the receptacle completely into the housing causes the means for overriding the biasing means to disengage the locking mechanism from the insertable structure and further wherein the sliding removal of the receptacle from the housing locks the insertable structure in the receptacle;

wherein after the receptacle is received in the housing of the cabinet, the insertable structure can be freely removed from or inserted into the locking mechanism.

10. The firearm cabinet of claim 9, further comprising an additional door that forms at least part of a wall member of the cabinet, wherein the receptacle includes a separate locking member to lock the receptacle in the housing.

11. The lockable firearm cabinet of claim 9, wherein the receptacle includes one or more activation buttons for sounding an alarm, activating a monitoring camera, or providing external communication when the firearm is removed from the receptacle, and wherein the insertable structure is removed from the firearm with a key.

12. The lockable firearm cabinet of claim 9, wherein the firearm is a handgun having a handle the bottom of which is releasably mounted onto the insertable structure, wherein the insertable structure has a width that is no larger than that of the handgun handle.

13. The lockable firearm cabinet of claim 12, wherein the receptacle includes a trigger engaging lock to prevent accidental discharge of the handgun when being transported.

* * * * *